United States Patent [19]

Pfäffle

[11] 4,155,134

[45] May 22, 1979

[54] METHOD AND MEANS FOR FORMING, INSERTING AND CLOSING ZIGZAG WIRE BINDERS

[75] Inventor: Ernst Pfäffle, Neuffen, Fed. Rep. of Germany

[73] Assignee: Hans Sickinger Co., Pontiac, Mich.

[21] Appl. No.: 892,279

[22] Filed: Mar. 31, 1978

[51] Int. Cl.[2] ..... B42C 5/12

[52] U.S. Cl. ..... 11/1 A

[58] Field of Search ..... 11/1 A, 1 AC; 281/21 A

[56] References Cited

U.S. PATENT DOCUMENTS 2,555,290 5/1951 November ..... 281/25

*Primary Examiner*—Gerald A. Dost

*Attorney, Agent, or Firm*—Harness, Dickey & Pierce

[57] ABSTRACT

A system for forming zigzag wire binder material in a continuous strip, storing the strip as it leaves the forming station, and severing lengths as needed at an adjacent station at which the binder lengths are inserted in books. The invention permits the binder strip forming mechanism and the binder cutting and inserting unit to be at a single location because the storage mechanism placed between these two units is responsive to speed differences between the strip forming and binder inserting units to temporarily stop one unit or the other until the length of binder strip in the storage unit is brought within a certain range. The inserting unit has novel means for forcing the opposite ends of the binder loops into the book holes, making the unit especially useful for heavy count books. This novel inserting means includes two series of pins which move in opposite directions to force the loops into the holes.

8 Claims, 7 Drawing Figures

Fig. 6.
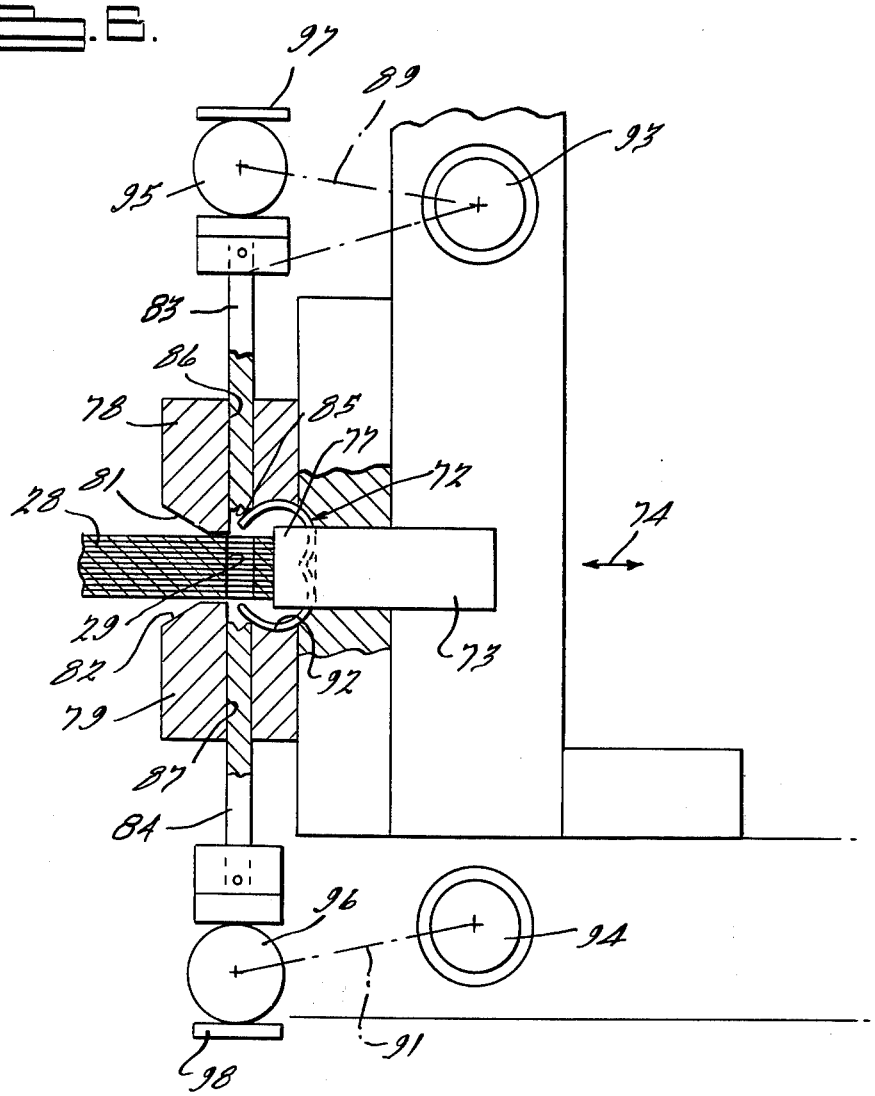
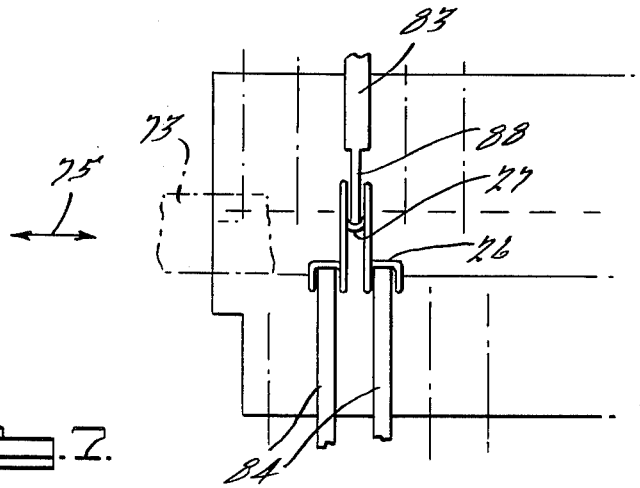
Fig. 7.

METHOD AND MEANS FOR FORMING, INSERTING AND CLOSING ZIGZAG WIRE BINDERS

BACKGROUND OF THE INVENTION

1. Field of the Invention

The invention relates to wire book binders and more particularly to the manufacture of binders having alternate wide and narrow loops extending in opposite directions, referred as zigzag wire binders.

2. Description of the Prior Art

A common method of manufacture of zigzag wire binders is to form a continuous strip of wire in looped or zigzag form, which is curved transversely to a partly closed form. The bindery will purchase drums of this preformed material which it places in a book binding machine. This machine will sever lengths of binder from the strip and close the binder by inserting the loops into the perforations along the spine of the book. Another procedure for binding books with zigzag wire binders is for the bindery to purchase already cut lengths of partly closed binders which are singly wrapped to prevent snarling. These are placed individually over the groups of sheets and the loops inserted in the perforations by a hand operated fixture.

Various constructions for inserting the wire loops in the perforations are known. Among them are those disclosed in the following patents and which are not believed to have the advantages of the present invention:

| | | |
|---|---|---|
| 2,555,290 | November | May 29, 1951 |
| 2,272,339 | Goodloe | February 10, 1942 |
| 3,334,918 | Pigna et al | August 8, 1967 |
| 3,451,081 | Liouville | June 24, 1969 |
| 3,667,076 | Aglaghanian et al | June 6, 1972 |
| 3,854,158 | Pigna et al | December 17, 1974 |
| 3,883,916 | Adams et al | May 20, 1975 |
| 3,889,309 | Adams et al | June 17, 1975 |
| 4,020,516 | Gomez | May 3, 1977 |
| 4,031,585 | Adams | June 28, 1977 |

BRIEF SUMMARY OF THE INVENTION

It is an object of the present invention to provide a novel and improved method and means for forming, inserting and closing, zigzag wire binders which eliminates the need for partly forming a continuous binder strip or individual binder lengths at a separate location, but which instead allows the bindery to purchase unformed wire, in bulk, form this wire into a partly closed binder strip, sever lengths of the strip into individual binders, and insert and close them in the books, all at the same location and as a continuous operation.

It is another object to provide an improved method and means for the manufacture or zigzag wire binders which insures coordinated production of the partly closed binder strip and cutting, inserting and closing of the individual binders regardless of the speed of the operator.

It is further object to provide an improved construction for the insertion and closing of the loops of partly closed binders in the book perforations which will work satisfactorily even with heavy count books, for example of ¾ of an inch or an inch in thickness, in an efficient and accurate manner.

Briefly, the method of this invention comprises the steps of forming a continuous strip of zigzag wire binder at a first station, continuously storing said strip at a second station, transporting said strip to a third station where lengths of the strip are cut, inserted and closed within the perforations of the books, stopping said cutting, inserting and closing operations at the third station in response to a reduction in the continuous strip at said second station below a predetermined amount, restarting said operations at the third station in response to an increase in the strip stored at said second station above a predetermined amount, stopping the formation of the continuous strip at said first station in response to an increase in the strip stored at said second station above a predetermined amount, and restarting said formation of the continuous strip at said first station in response to a reduction in the strip at said second station below a predetermined amount.

In another aspect, the invention comprises means at a first station for forming a continuous strip of zigzag wire binder, means for feeding said continuous strip in response to said forming operation to a second station where the strip is continuously stored, a third station having means for cutting, inserting and closing individual lengths of wire binder in book perforation, means responsive to said cutting, inserting and closing operation at the third station for transporting said stored continuous strip from said second to said third station, means responsive to an increase in the length of continuous wire binder at said second station beyond a certain point for stopping the production of said strip at the first station, and means responsive to a reduction in the length of said continuous strip at the second station to stop said cutting, inserting and closing means at the third station.

In still another aspect, the invention comprises a zigzag wire binder inserting and closing mechanism having oppositely facing guide means for receiving a perforated book spine therebetween, a carriage slidable parallel to said spine and engageable with a partly closed zigzag length of binder, said carriage being movable toward said spine to carry a partly closed binder length into position over the spine and also being retractable transversely to said spine to a retracted position away from said binder, and two series of oppositely facing pins slidably mounted in said guide means, said pins being aligned with said perforations and movable in opposite directions to simultaneously engage the loops on both sides of said binder so as to force the loops into said perforations.

BRIEF DESCRIPTION OF THE DRAWINGS

FIG. 3 is a partial fragmentary view showing the manner of storing the continuous binder strip at the second station and also showing the locations of the limit switches, FIG. 6 is a partially schematic and cross-sectional view in elevation of the pin mechanism for inserting and closing the binder loops in the book spine perforations, and FIG. 7 is a partial side elevational view of the mechanism shown in FIG. 6 and illustrating how the pins engage the wire loops.

DESCRIPTION OF THE PREFERRED EMBODIMENT

Figure 1:
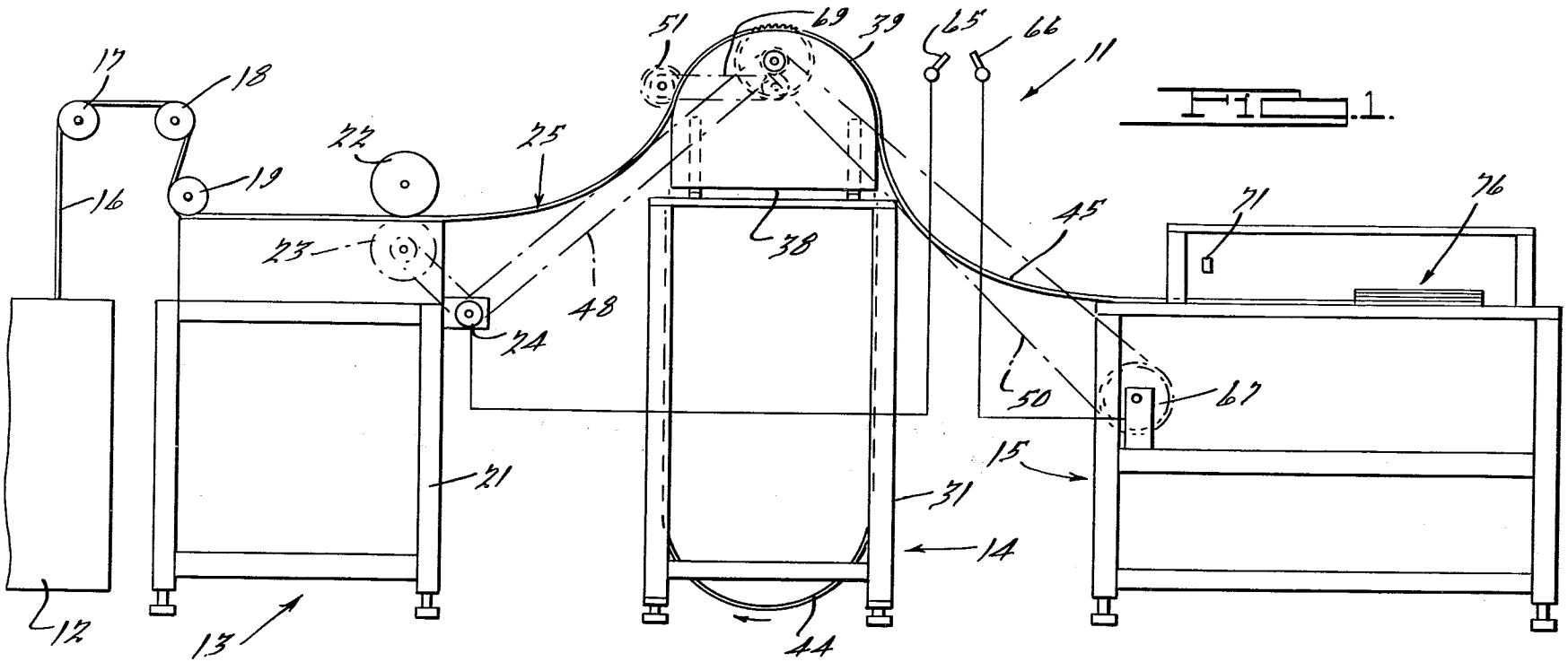
FIG. 1 is a side elevational view of the assembly of stations showing the connection between them.

The system is generally indicated at 11 and includes a wire storage unit 12, a binder strip forming unit generally indicated at 13, a strip storage unit generally indicated at 14 and a binder cutting, inserting and closing unit generally indicated at 15. These devices are arranged in a tandem with the storage unit 12, in the form for example of a drum, being in advance of a first station at which unit 13 is placed. Unit 14 is located at a second or storage station and unit 15 at a third station.

Conventional means, not illustrated in detail, are provided on unit 13 for forming the straight wire 16 into a series of oppositely extending loops with alternate wide and narrow ends, partly curved transversely to its length so as to permit reception of the book spine before being closed by insertion in the perforations at the third station. Wire 16 is a continuous straight wire and is led by guides such as those indicated at 17, 18 and 19 to unit 13. This unit has a base 21 which supports elements indicated at 22 and 23 and a motor 24 which form a continuous strip shown partially in FIG. 5 and indicated generally at 25. This strip has oppositely extending loops with alternate wide ends 26 and narrow ends 27 which are partly curved so as to leave a gap for the reception of a group of sheets indicated at 28 in FIG. 6, the sheets having perforations 29.

Figure 2:
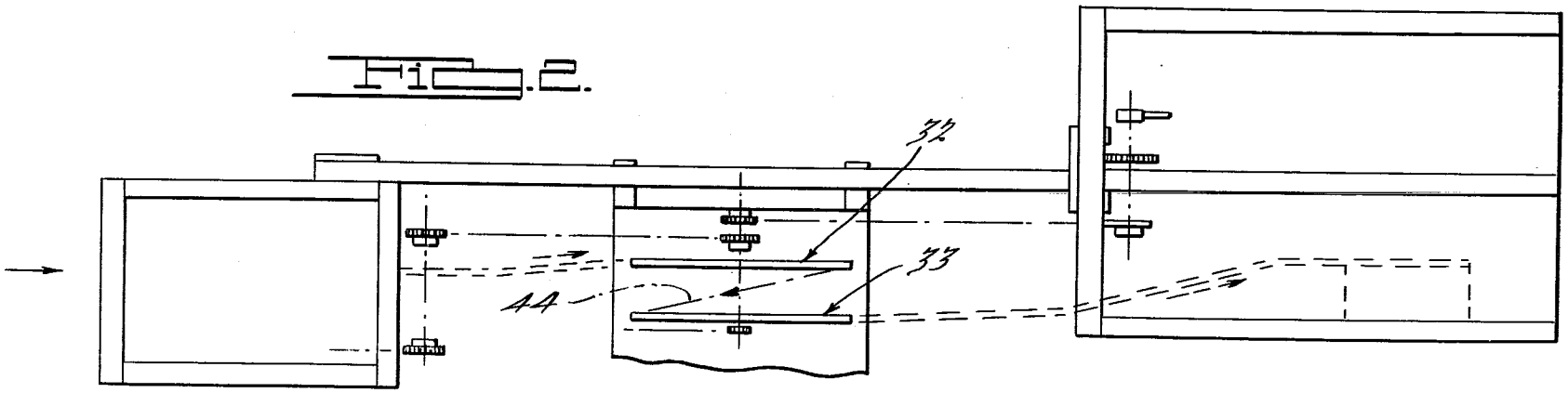
FIG. 2 is a partial top plan view of said stations showing the manner in which the continuous strip is stored at the second station.
Figures 2, 4, 5:
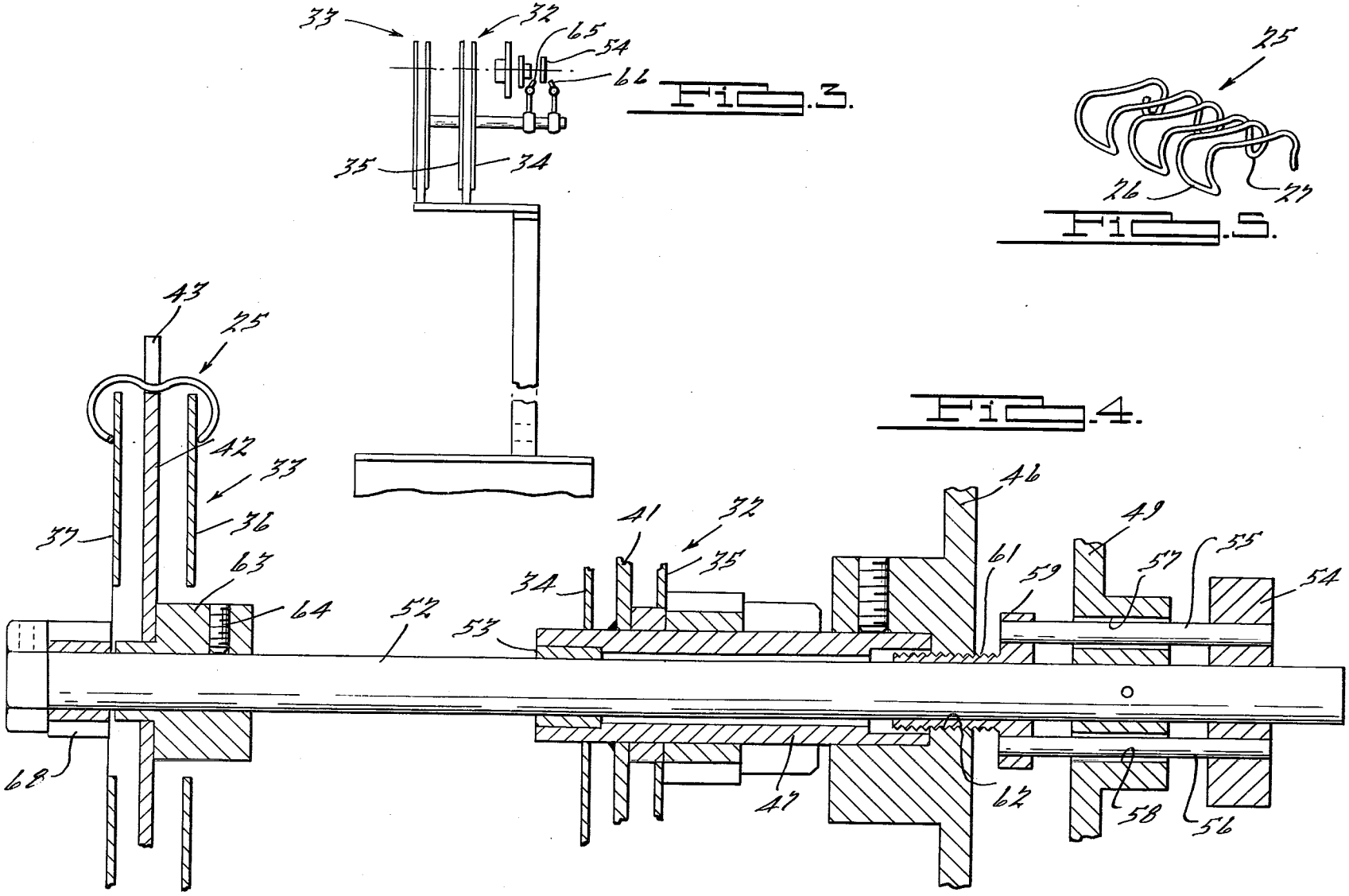
FIG. 4 is a fragmentary enlarged elevational and cross-sectional view of the storage station showing the threaded connection between the two drive pulleys.
FIG. 5 is a partial perspective view showing the construction of the half formed binder.

The construction of storage unit 14 is shown best in FIGS. 1 through 4. This unit has a base 31. Surmounting the base are two loop supports generally indicated at 32 and 33, these supports being in side by side relation as shown in FIGS. 2 and 3. Each loop support is intended to carry one loop of strip 25. Loop support 32 comprises a pair of stationary plates 34 and 35, while loop support 33 has plates 36 and 37. These four plates are similarly shaped, having a flat lower edge 38 as shown in FIG. 1 and in upwardly convex arcuate upper edge 39. The spacing between each pair of plates is such that strip 25 may ride along the top edges of the plastes as seen in FIG. 4 for plates 36 and 37. A sprocket 41 is provided between plates 34 and 35 and a similar sprocket 42 between plates 36 and 37. These sprockets have teeth 43 adapted to engage strip 25 between the loop sides. The first loop will hang down past support 32 and its bottom will extend diagonally as indicated at 44 in FIG. 2, thus beginning the second loop which is draped on support 33. The strip 25 is fed from unit 13 to support 32 and leads from support 33 to unit 15 as indicated at 45 in FIG. 1.

The means for driving sprocket 41 in strip support 32 comprises a sprocket 46 secured to a hollow shaft 47, this shaft passing through plates 34 and 35 and carrying sprocket 41 thereon. Sprocket 46 is driven by a chain 48 (FIG. 1) from motor 24 of unit 13. Thus, whenever strip forming unit 13 is operating to manufacture the binder strip, the loop draped over support 32 will become longer. When motor 24 and therefore unit 13 stops, the feeding movement of strip 25 to storage unit 14 will cease.

Sprocket 42 is driven from unit 15 by means of a sprocket 49 driven by a chain 50 (FIG. 1). An additional sprocket 51 is driven from chain 50 as will be later described in order to lift the draped binder leaving support 32 onto support 33. Sprocket 49 is fixed to a shaft 52 which extends through hollow shaft 47, the hollow shaft carrying a bearing 53 supported by shaft 52 so as to be rotatable with respect thereto. A disc 54 is rotatably mounted on one end of shaft 52 and carries a plurality of axially extending pins 55 and 56 which pass through openings 57 and 58 respectively in sprocket 49. The other ends of pins 55 and 56 are attached to the head 59 of a nut 61 which is rotatably mounted on shaft 52 and threadably mounted within an internal thread 62 on sprocket 46. The other end of shaft 52 is secured to sprocket 42 by a bushing 63 and set screw 64. Disc 54 is disposed between a pair of limit switches 65 and 66 (FIGS. 1 and 3) so that axial movement of disc 54 to the right in FIG. 3 will actuate switch 66 whereas movement to the left will actuate switch 65. Each switch will move to its deactivated position when disc 54 is withdrawn therefrom. The spacing between switches 65 and 66 may be chosen so that a slight predetermined gap exists.

The arrangement is therefore such that when units 13 and 15 are operating at the same rate of speed, nut 61 will rotate along with sprocket 46 and there will be no relative axial movement of disc 54 with respect to limit switches 65 and 66. However, should unit 15 be stopped but unit 13 continue to operate, the bottom 44 of strip 25 between the portions draped on supports 32 and 33 will descend while at the same time disc 54 will be moved to the left because of the relative rotation between nut 61 and sprocket 46. After a predetermind degree of such relative rotation, switch 65 will be actuated, this switch being connected to motor 24 as shown schematically in FIG. 1 so as to stop unit 13. If unit 15 continues to operate, the bottom 44 of the stored strip will begin to ascend and at the same time disc 54 will be withdrawn from switch 65 permitting unit 13 to recommence operation.

But the same token, should unit 15 continue to operate while unit 13 is idle, the bottom of 44 of strip 25 in storage unit 14 will ascend, while at the same time the relative rotation between nut 61 and sprocket 46 will move disc 54 to the right. At a predetermined point this dics will engage limit switch 66 which is connected with a motor 67 of unit 15. Actuation of limit switch 66 will stop unit 15 and if unit 13 continues to operate the bottom of the stored strip in unit 14 will again begin to descend. This will means that disc 54 is withdrawn from switch 66 permitting unit 15 to recommence operation. Thus, regardless of the rates of operation of units 13 and 15, unit 14 will always maintain the proper amount of slack in strip 25 between these two units.

The means for driving sprocket 51 comprises a sprocket 68 secured to the end of shaft 52 and connected to sprocket 51 by a chain 69.

The construction of the operating portions of unit 15 are shown in FIGS. 1, 6 and 7. A conventional cutter indicated schematically at 71 in FIG. 1 will sever lengths of binder from strip 25, an individual binder being indicated generally at 72 in FIG. 6. A carriage 73 is provided in the form of a comb having two directions of movement, an advancing and retracting movement indicated by the double ended arrow 74 in FIG. 6 and a back and forth movement parallel to the book spine indicated by the double ended arrow 75 in FIG. 7. Comb 73 is mounted for movement between the cutting location where cutter 71 is located and the binding location indicated generally at 76 in FIG. 1. After each length of binder 72 is cut it will be transported by comb 73 from the location of cutter 71 to binding location 76, the teeth 77 of comb 73 interfitting between the loop sides. As the binder is so moved it will overlap both sides of an unbound group of perforated sheets 28 which has been previously inserted between a pair of guides 78 and 79. These guides have flared surfaces 81 and 82 respectively for the reception of sheet group 28. The guide also slidably support two sets of pins 83 and 84 respectively. These pins are notched at their outer ends as indicated at 85 and are adapted to engage the narrow loop ends 27 and the wide loop ends 26 respectively of the binder. The pins are mounted for vertical movement within bores 86 and 87 of guides 78 and 79 respectively, the pins being aligned with perforations 29 after the sheet group 28 has been properly positioned. The movement of carriage 73 will also be such that the loop ends will be aligned with the pins and the perforations when movement is completed. Pins 83 have narrow ends 88 for proper engagement with loop ends 27.

Means such as cranks 89 and 91 are provided for actuating pins 83 and 84 respectively between outer positions as shown in FIG. 6 and inner positions. In their outer positions, the pins are spaced apart so as to permit entry of the loops into aligned position whereas the advanced position of the pins will cause the loops to bend inwardly so as to be inserted into perforation 29 and closed to form a complete zigzag binder. During this movement, carriage 73 will be positioned as shown so as to properly support the binder which is being bent into its final position. Guides 78 and 79 are provided with curved surfaces such as that indicated at 92 for the proper reception and support of binder 72. After the binder has been bent into its fully closed position, carriage 73 will be retracted to the right in FIG. 6 and then returned to the left in FIG. 7 so as to pick up the next binder 72. Pins 83 and 84 will be retracted by cranks 89 and 91, these being driven by shafts 93 and 94 respectively and carrying cams 95 and 96 disposed within cam retainers 97 and 98. After retraction of the pins the bound hook 28 may be withdrawn to the left and the next group of unbound sheets inserted into position for binding.

In operation, the wire 16 fed from storage unit 12 will be formed into a strip as shown in FIG. 5 at unit 13 and will then be fed to storage unit 14. The amount of strip 25 in the storage unit will remain within limits. However, should the amount become excessive, operation of limit switch 65 will temporarily stop unit 13 while a relatively low supply of storage strip in unit 14 will cause cutting, inserting and closing unit 15 to stop temporarily until the supply is replenished.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

I claim:

1. A method for binding books having perforations along the spine, comprising the steps of forming a continuous strip of zigzag wire binder at a first station, continuously storing said strip at a second station, transporting said strip to a third station where lengths of the strip are cut, inserted and closed within the perforations of the books, stopping said cutting, inserting and closing operations at the third station in response to a reduction in the continuous strip at said second station below a predetermined amount, restarting said operations at the third station in response to an increase in the strip stored at said second station above a predetermined amount, stopping the formation of the continuous strip at said first station in response to an increase in the strip stored at said second station above a predetermined amount, and restarting said formation of the strip at said first station in response to a reduction in the strip at said second station below a predetermined amount.

2. In combination, means at a first station for forming a continuous strip of zigzag wire binder, means for feeding said continuous strip in response to said forming operation to a second station where the strip is continuously stored, a third station having means for cutting, inserting and closing individual lengths of wire binder in book perforation, means responsive to said cutting, inserting and closing operation at the third station for transporting said stored continuous strip from said second to said third station, means responsive to an increase in the length of continuous wire binder at said second station beyond a certain point for stopping the production of said strip at the first station, and means responsive to a reduction in the length of said continuous strip at the second station to stop said cutting, inserting and closing at the third station.

3. The combination according to claim 2, said means for stopping production at said first station comprising means at said second station for sensing the differential in speeds of operation at said first and third stations.

4. The combination according to claim 3, said continuous strip being stored in a loop in said second station, said sensing means comprising means at said second station for feeding said strip from said first station into said loop and withdrawing the strip from said loop to said station, and means for measuring the relative speeds between said two last mentioned means.

5. The combination according to claim 4, said means for feeding and withdrawing said strip comprising first and second sprockets engaging said strip, said first sprocket being rotated in response to operation of said forming mechanism at the first station and said second sprocket being rotated in response to operation of the cutting, inserting and closing mechanism at the third station.

6. The combination according to claim 5, further provided with a threaded connection between said two sprockets, axially movable means connected to said threaded connection, and limit switch means coacting with said axially moving means.

7. In combination, a zigzag wire binder inserting and closing mechanism having oppositely facing guide means for receiving a perforated book spine therebetween, a carriage slidable parallel to said spine and engageable with a partly closed zigzag length of binder, said carriage being movable toward said spine to carry a partly closed binder length into position over the spine and also being retractable transversly to said spine to a retracted position away from said binder, and two series of oppositely facing pins slidaly mounted in said guide means, said pins being alinged with said perforations and movable in opposite directions to simultaneously engage the loops on both sides of said binder to force the loops into said perforations.

8. The combination according to claim 7, the ends of said pins being notched to engage said loops, said pins being sufficiently thin to enter said perforations.

* * * * *

UNITED STATES PATENT AND TRADEMARK OFFICE

CERTIFICATE OF CORRECTION

PATENT NO. : 4,155,134

DATED : May 22, 1979

INVENTOR(S) : Ernst Pfaffle

It is certified that error appears in the above-identified patent and that said Letters Patent are hereby corrected as shown below:

Col. 4, line 44 "dics" should be --disc--.

Col. 4, line 48 "means" should be --mean--.

Col. 5, line 41 "hook" should be --book--.

Col. 6, line 36 after "said" insert --third--.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*